US007708845B2

(12) United States Patent
Tetyukhin et al.

(10) Patent No.: US 7,708,845 B2
(45) Date of Patent: May 4, 2010

(54) METHOD FOR MANUFACTURING THIN SHEETS OF HIGH STRENGTH TITANIUM ALLOYS DESCRIPTION

(75) Inventors: Vladislav Valentinovich Tetyukhin, Moscow (RU); Igor Vasilievich Levin, Verkhnaya Salda (RU); Alexander Nikolaevich Kozlov, Verkhnaya Salda (RU); Andrey Vladimirovich Zaitsev, Verkhnaya Salda (RU); Alexander Vladimirovich Berestov, Verkhnaya Salda (RU)

(73) Assignee: The Boeing Company, Chicago, IL (US)

( * ) Notice: Subject to any disclaimer, the term of this patent is extended or adjusted under 35 U.S.C. 154(b) by 959 days.

(21) Appl. No.: 11/351,533

(22) Filed: Feb. 10, 2006

(65) Prior Publication Data

US 2007/0007281 A1 Jan. 11, 2007

Related U.S. Application Data

(63) Continuation of application No. PCT/RU2004/000330, filed on Aug. 25, 2004.

(51) Int. Cl.
*C22F 1/18* (2006.01)

(52) U.S. Cl. ..... 148/670; 219/615

(58) Field of Classification Search ..... 219/602, 219/635; 148/689, 670, 421; 29/17.3
See application file for complete search history.

(56) References Cited

U.S. PATENT DOCUMENTS

| | | | | |
|---|---|---|---|---|
| 2,985,945 A | | 5/1961 | Fronek et al. | |
| 3,169,085 A | * | 2/1965 | Newman | 148/670 |
| 3,492,172 A | | 1/1970 | Patridge et al. | |
| 4,581,077 A | * | 4/1986 | Sakuyama et al. | 148/670 |
| 2001/0041148 A1 | * | 11/2001 | Oyama et al. | 148/669 |
| 2003/0089433 A1 | | 5/2003 | Oyama et al. | |

FOREIGN PATENT DOCUMENTS

| | | | |
|---|---|---|---|
| EP | 0 896 839 A | | 2/1999 |
| JP | 61-110756 | * | 5/1986 |
| JP | 63 176452 A | | 7/1988 |
| JP | 10 128308 A | | 8/1998 |
| JP | 2001 038413 A | | 2/2001 |
| JP | 2001 121206 A | | 3/2001 |

* cited by examiner

*Primary Examiner*—Quang T Van
(74) *Attorney, Agent, or Firm*—Harness, Dickey & Pierce, P.L.C.

(57) ABSTRACT

Disclosed is a method for manufacturing thin sheets of high-strength titanium alloys. The method includes the steps of preparing initial blanks, assembling the initial blanks into a pack within a sheath, and heating and hot rolling the pack of the initial blanks in the sheath. The method is characterized in that, in the step of preparing the initial blanks, blanks having an (α-phase grain size of not more than 2 μm are produced by hot rolling a forged or die-forged slab to a predetermined value of a relative thickness $h_B/h_F$, where $h_B$ is a thickness in mm of the initial blank before said pack hot rolling and $h_F$ is a final sheet thickness in mm, and by heat treating the initial blanks followed by rapidly cooling; and in that the step of pack hot rolling is conducted in quasi-isothermal conditions in longitudinal and transverse directions, while changing a rolling direction by about 90° after a predetermined total reduction in one direction is achieved. The method provides big-sized thin sheets made of high-strength titanium alloys and having homogeneous submicrocrystalline structure where an average grain size is less than 1 μm. The sheets have the required mechanical properties suitable for superplastic forming (SPF) at temperatures below 800° C.

8 Claims, 3 Drawing Sheets a) ×1000 b) ×1000

METHOD FOR MANUFACTURING THIN SHEETS OF HIGH STRENGTH TITANIUM ALLOYS DESCRIPTION

CROSS-REFERENCE TO RELATED APPLICATIONS

This application is a continuation of International Patent Application No. PCT/RU2004/000330 filed on Aug. 25, 2004, and also claims the benefit of Russian Patent Application Nos. RU2003/125891 and RU2003/125890, both filed on Aug. 25, 2003. The disclosures of these applications are incorporated herein by reference.

FIELD

The present invention relates to the field of metal forming, in particular to a method for manufacturing thin sheets of high-strength titanium alloys by pack rolling.

BACKGROUND

Well known is a method for producing thin sheets having thicknesses of from about 0.076 to about 1.0 mm (0.003 to 0.04 inch) and made of titanium (Ti), zirconium (Zr) and alloys thereof (see the U.S. Pat. No. 2,985,945 published May 30, 1961). The method includes the steps of preparing a card blank, assembling a plurality of the blanks into a pack in an outer sheath (a steel case), heating the pack up to about 730-757° C. (from about 1345 to 1395° F.), hot rolling the pack, annealing the pack, cold rolling the pack at a reduction of from 10 to 60%, heat treating the pack, end cropping and end trimming the pack and separating the trimmed pack into component sheets, and finishing the sheets. The method allows to obtain required mechanical properties of the sheets in longitudinal and transverse directions by maintaining optimum temperature-deformation conditions of the process. The produced sheets have a grain size of 4 to 6 μm (microns) and greater. This method may be considered as the prior art closest to the methods claimed in the present invention.

However, the processing of high-strength alloys in the suggested temperature range is difficult and causes formation of microcracks and breaks in the processed material. In addition, the sheets produced by the above-described method can be used to form articles of a complex shape by superplastic forming (SPF) only at high temperatures (900-960° C.), which significantly complicates the technological process and makes the produced articles more expensive. Decrease of the SPF temperature below 800° C. causes an abrupt increase of stresses during deformation.

Also known from the prior art (see the U.S. Pat. No. 3,492,172 of Jan. 27, 1970) is a method for producing strips of a metal selected from the group consisting of commercially pure titanium, alpha stabilized alpha type titanium base alloys and alpha stabilized alpha-beta type titanium base alloys, which comprises: (1) unidirectionally hot rolling a body of said metal to reduce said body to an elongated hot band, said rolling being initiated at a temperature requiring a substantial amount of said reduction to occur in the alpha-beta field of said metal; (2) heating said hot band at a temperature above the beta transus of said metal to completely transform the crystal structure of said metal to the beta phase; (3) rapidly cooling said hot band from said temperature above the beta transus of said metal to a temperature below said beta transus to produce acicular type microstructure in the metal; and (4) subjecting said rapidly cooled hot band to the steps of rolling and annealing at temperatures below said beta transus to produce an elongated strip having a substantially completely recrystallized microstructure.

A method for manufacturing thin sheets of strength and high-strength titanium-based alloys is also known in the prior art (see the Russian Patent No. RU 2,179,899, IPC$^7$ B21B 1/38, published on Feb. 27, 2002 and assigned to the present applicant). This method includes the steps of preparing card blanks, assembling the blanks into a pack in a steel case, heating the pack up to 880° C. and hot rolling the pack at a reduction rate of 60%, annealing the pack at the temperature of 770° C. for 30 min, straightening the pack, disassembling the pack into separate sheets, and finishing the sheets.

This method allows to obtain the sheets having α-phase grain sizes of 2-4 μm in their microstructure, which are quite sufficient for producing articles from these sheets by the SPF at temperatures of 900-960° C. This is an optimum temperature range in order to obtain necessary values of flow stress and elongation at a strain rate of from $10^{-3}$ to $10^{-4}$ $sec^{-1}$.

However, decrease of the SPF temperature below 800° C. causes an abrupt increase in flow stresses up to 75 MPa (for a true deformation value of 1.1) and the sheets produced by this known method are therefore not suitable for the SPF at temperatures below 800° C.

The article manufacturing process using the SPF is commonly performed in special furnaces into which dies are placed and heated up to a deformation temperature of 900-960° C. A heated inert gas which creates a formation strain needed to shape the article is supplied under pressure to a workpiece through channels made in an upper die. Due to such high SPF temperatures, a lifetime of the tool (dies) is very short and energy consumption is extremely high. Therefore, a need to decrease the SPF temperature during the article manufacturing process down to 800° C. and below exists till the present time.

It is known that, in order to widen the temperature—strain rate interval during the SPF, α-phase grain sizes should be decreased (O. A. Kaybyshev. "Superplasticity of industrial alloys". Moscow, 'Metallurgy' Publisher, 1984). Particularly, it is known at the present time that, in order to reduce the SPF deformation temperature, it is necessary to obtain a workpiece having submicrocrystalline structure (SMCS) with a grain size of 1 μm or lower (see "Forging production" in Russian, 1999, No. 7, pp. 17-19). The workpieces or semi-finished products having such grain sizes would allow to reduce the SPF deformation temperature by several hundred degrees, depending on an alloying (doping) level of the alloys.

One of the most technically acceptable ways to obtain this workpiece structure is to use a polygonal (many-sided) isothermal forging method. There are some difficulties, however, in implementation of the presently proposed methods in production quantities using the currently existing equipment.

Also known is a method for processing metal and alloy billets by thermomechanical deformation in one or several steps, which method provides refining of billet material microstructure by choosing load conditions (see the Russian Patent No. 2,203,975, IPC$^7$ C22F 1/18, which is issued May 10, 2003 and corresponds to the International patent application publication WO 01/81026 of Nov. 1, 2001). The load conditions provide microstructure transformation during a deformation and/or heat treatment process. Quantity of the deformation steps and the type of load are chosen taking into account configurations of the initial and final billets and grain size of the initial billet. At the first stage, the billet is obtained by multicomponent loading, in particular, by loading of "torque—tensile (compressive)" type. Further deformation of the billet is conducted in a sheath. This method allows to obtain the billets mostly of a round cross-section and a grain size less than 0.5 μm.

A major drawback of this method is a low process manufacturability, limited shapes and sizes of the produced billets. Realization of the process in production quantities requires great investment costs to provide necessary equipments and tools.

Thus, the above analysis of the current patent and literature prior art has proved a necessity to provide a technological method for manufacturing, in production quantities and with the use of currently existing equipment, big-sized semifinished products made of high-strength titanium alloys and having homogeneous submicrocrystalline structure.

SUMMARY

Based on the above, an object to be solved by the present invention is to provide a method for manufacturing big-sized flat semifinished products (thin sheets) made of high-strength titanium alloys and having homogeneous submicrocrystalline structure (SMCS), i.e. with an average grain size of 1 μm or lower, said products having required mechanical properties and being suitable for superplastic forming (SPF) at temperatures lower than 800° C.

According to the first aspect of the present invention, the above object is solved by providing a method for manufacturing thin sheets of high-strength titanium alloys, said method including the steps of preparing initial blanks, assembling the initial blanks into a pack within a sheath, and heating and hot rolling the pack of the initial blanks in the sheath. The method is characterized in that, in the step of preparing initial blanks, blanks having an α-phase grain size of not more than 2 μm are produced by hot rolling of a forged or die-forged slab to a predetermined value of a relative thickness $h_B/h_F$, where $h_B$ is a thickness of the initial blank before said hot rolling of the pack in mm and $h_F$ is a final sheet thickness in mm, and by heat treating the initial blanks followed by rapid cooling; and in that the step of hot rolling of the pack of the initial blanks is conducted in quasi-isothermal conditions in longitudinal and transverse directions, while changing a rolling direction by about 90° after a predetermined total reduction in one direction is achieved.

According to one preferred embodiment of the method, said predetermined value of relative thickness $h_B/h_F$ is from about 8 to about 10.

According to another preferred embodiment of the method, said heat treatment of the initial blank followed by said rapid cooling are performed after achievement of the required thickness $h_B$ of the initial blank (before said hot rolling of the pack) by heating the initial blank to a temperature $T_{treat}$ which is from about 50 to about 150° C. higher than the alpha-beta phase transition temperature which is sometimes called as the beta-transus temperature or simply as BTT (i.e. $T_{treat}$=BTT+(50÷150° C.)), and by keeping the initial blank at this temperature $T_{treat}$ for about 15 to about 50 minutes, and by rapid cooling the initial blanks in water at a cooling rate of from about 200 to about 400° C./min.

According to still another preferred embodiment of the method, a temperature $T_{roll}$ during said hot rolling of the pack is set in the range of from about 200 to about 300° C. lower than the beta-transus temperature, i.e. $T_{roll}$=BTT−(200÷300° C.).

According to still another preferred embodiment of the method, said change of the rolling direction by about 90° during the step of hot rolling of the pack is performed after a predetermined total reduction of from about 60 to about 70% in one direction is achieved.

According to still another preferred embodiment of the method, a partial reduction value of the pack in one heating cycle is not less than 10%, the reduction in each subsequent rolling run of the pack being not greater than that in the previous rolling run.

According to still another preferred embodiment of the method, the temperature of each subsequent rolling run of the pack is not higher than that of the previous rolling run.

Thus, generation of the initial blank structure having the grain size of less than 2 μm is preferably achieved by heat treatment of the finally sized blank followed by cooling at the predetermined cooling rate. In other words, the heat treatment is conducted at the $T_{treat}$ for the predetermined time period followed by the subsequent rapid cooling in water (i.e. quenching) after the hot rolling of the slab to produce the initial blank is completed. This mode of operation enables to obtain acicular α'-martensite having the grain size of not more than 2 μm in the structure of the initial blank material.

Further grain refining is provided by the thermo-mechanical deformation of the blank pack in the sheath (e.g., in a steel case). The hot rolling at $T_{roll}$=BTT−(200÷300° C.) to effect the reduction of 60-70% destroys this acicular α'-martensite. As a result, the structure is transformed into α-phase which is deformed to generate stringer-type inclusions which consist of the finest grains, thereby providing the desired submicrocrystalline structure.

The range of initial blank relative thickness $h_B/h_F$ of from 8 to 10 is set based on the condition of providing a necessary plastic deformation to obtain the sheets having grain size of 1 μm or lower during the hot rolling of the blanks in the sheath.

Crystallographic texture of the sheets is formed by directing the blank pack rolling. The change of longitudinal and transverse pack rolling directions (turning at 90 degrees) allows to obtain the optimum crystallographic texture in the sheets and to reduce anisotropy of their mechanical properties.

Partial reduction value of the pack in one heating cycle is set to be not less than 10% based on the condition that the whole cross-section of the processed blank is completely worked out. Due to the fact that the pack temperature drops slowly during the hot rolling step, decrease of the partial reduction value is provided in order to maintain the constant energy-force parameters of the process.

The temperature of each subsequent hot deformation cycle is chosen to be not higher than that of the previous cycle in order to maintain the grain sizes obtained in the previous cycle.

According to the second aspect of the present invention, the above object is solved by providing a method for manufacturing thin sheets of high-strength titanium alloys, said method including the steps of preparing initial card blanks, assembling the initial card blanks into a pack within a steel case, heating and hot rolling the pack of the initial card blanks in the steel case, and annealing. The method is characterized in that, in the step of preparing initial card blanks, blanks having an α-phase grain size of not more than 2 μm are produced by hot rolling of a forged or die-forged slab to a predetermined value of a relative thickness $h_B/h_F$=8 to 10, where $h_B$ is a thickness of the initial card blank before said hot rolling of the pack in mm and $h_F$ is a final sheet thickness in mm; and in that the thus produced initial card blanks are heated to a temperature from about 50 to about 150° C. higher than the beta-transus temperature BTT, are kept at this temperature for about 15 to about 50 minutes, and are quenched by cooling in water at a cooling rate of from about 200 to about 400° C./min; and in that the hot rolling of the pack in the steel case heated up to a temperature of from about 650 to about 750° C. is firstly conducted in a longitudinal or transverse direction with respect to the rolling direction of the slab at a total reduction of from about 60 to about 70%, and is subsequently conducted at the same temperature-reduction parameters in a direction perpendicular to the direction of the first hot rolling of the pack; and in that, after said hot rolling of the pack, the steel case is annealed at a temperature of from about 650 to about 700° C. for a time period of about 30 to about 60 minutes.

The method according to the second aspect of the present invention is particularly suitable for manufacturing thin sheets made of high-strength titanium alloys of Ti-6Al-4V type. The heating of initial card blanks to the temperature of 50-150° C. above the beta transus (i.e. the temperature at which β-phase exists) followed by the subsequent water quenching allows to obtain acicular (needle-shaped) α'-martensite having a thickness of not more than 1 μm. During the subsequent heating up to 650-750° C. and hot rolling of the pack at the 60-70% reduction, the acicular α'-martensite is destroyed and transforms into α-phase which, in turn, deforms to generate stringer-type inclusions (inclusion lines) that consist of the finest grains. These finest grains allow to obtain the desired submicrocrystalline structure that improves superplasticity of the alloy.

The pack rolling direction is of great importance for formation of crystallographic texture of the sheets. By changing the sequence of longitudinal and transverse rolling of the pack (turning at 90 degrees) relative to the rolling direction of the initial blank (i.e. of the slab), it is possible to generate different crystallographic textures within the sheets and to reduce anisotropy of the mechanical properties.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
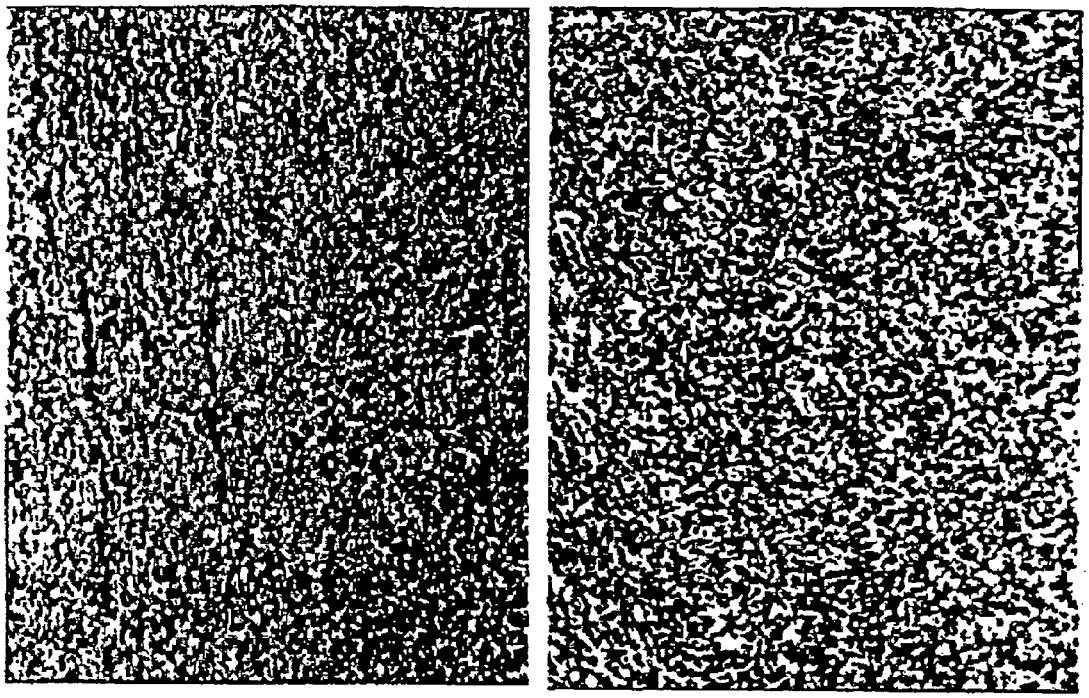
FIGS. 1*a*) and 1*b*) are micrographs showing microstructure of the sheets produced according to the present invention in Example 1 and Example 2, respectively.

The following description of the preferred embodiment(s) is merely exemplary in nature and is in no way intended to limit the invention, its application, or uses.

For trial development of the suggested method for the manufacture of the sheet suitable for SPF at temperatures below 800° C., a chemical composition of Ti-6Al-4V alloy within the limits of AMS-T-9046 specification has been selected to have the following content of elements, by wt. %: 5.5-6.0 Al, 4.0-4.5 V, 0.08-0.16$O_2$, 0.2-0.3 Fe, 0.06-0.1 Ni, 0.06-0.1 Cr; not more than 0.005 C, not more than 0.005 N, Ti— the balance.

The goal of selecting the chemistry was to maximally increase the content of β-phase in the alloy by increasing the content of alloying elements which stabilize β-phase (so called β-phase stabilizing elements). This results in decrease of the transus temperature of β-phase into α-phase and, subsequently, in decrease of the temperature at which the equal quantity of these phases is established (50% of α-phase and 50% of β-phase) that is necessary to obtain the best superplasticity properties in the alloy, i.e. to decrease the flow stress during the SPF.

Sheets having the dimensions of 2.23×915×1650 mm (Example 1) and 2.032×1219×3658 mm (Example 2) were manufactured by the method according to the present invention from an ingot of the above described chemical composition. The beta-transus temperature (BTT) of this alloy is 940° C.

Example 1

A beta-forged slab was heated in an electrical furnace to a temperature which is 40° C. below the beta-transus temperature (i.e. BTT minus 40° C.) and was hot-rolled at a total reduction (i.e. a total deformation rate) of 25% to produce a rolling stock. The produced rolling stock was then heated again to a temperature which is 140° C. above the beta-transus temperature (BTT+140° C.) and was hot-rolled at a total reduction of 69%. After the step of cutting the rolling stock into mults and of removing a gas-saturated layer, the thus produced rolling stock was heated to a temperature which is 40° C. below the beta-transus temperature (BTT−40° C.) and was hot-rolled in the α+β-area (alpha+beta) at a total reduction of 50% to produce a strip having a thickness of 20 mm ($h_B/h_F$=8.97). The thus produced 20 mm thick strip was cut into cards (i.e. initial blanks) being sized as 1380×1120 mm. The cards was then heated to the temperature of 1050° C. (BTT+110° C.), was held for 30 minutes and was quenched into water at a cooling rate of 300° C./min. After removal of a gas-saturated layer and defects from the card surface, the cards were arranged one above other (i.e. stacked) to form a pack within a case made of carbon steel. The thus assembled steel case was then heated to the temperature of 700° C. (BTT−240° C.) and was firstly hot-rolled in a direction transverse with respect to the slab rolling direction at a total reduction of 63% to obtain a thickness of 7.2 mm. The cards were put in a case for producing final sheets, were again heated to the temperature of 700° C. (BTT−240° C.) and, after being turned at 90 degrees, were subsequently hot-rolled in a direction transverse to the first rolling direction of the pack at a total reduction of 63% to obtain sheets having a thickness of 2.4 mm. Then the case was annealed at the temperature of 650° C., with a holding time at this temperature being 60 minutes.

The case was end-trimmed and the trimmed pack was separated into separate sheets. Standard finishing operations were then carried out for the separate sheets. Said operations include straightening of the sheet at a roller leveler, grinding, etching, cutting of a test sample, and trimming of the sheet to a final size. As a result, the sheets sized as 2.23×915×1650 mm were produced.

Example 2

Sheets sized as 2.032×1219×3658 mm were produced in a manner similar to the Example 1 with the use of double pack rolling. The only difference was in change of the rolling direction after the initial card blanks had been quenched to α'-martensite (i.e. in change of the direction of first pack rolling). In this Example 2, the pack was firstly hot-rolled in the direction longitudinal to the slab rolling direction and then the pack was hot-rolled in the direction transverse to the first pack rolling direction.

Mechanical tests was carried out on the samples taken from the sheets manufactured by the method according to Example 1 and Example 2. Results obtained in these tests for mechanical properties are listed below in the Table, wherein "0.2YS" denotes the 0.2% Yield Strength in MPa; "UTS" denotes the ultimate tensile strength in MPa; "E" denotes the elongation in percents:

| | Along to rolling direction | | | Across to rolling direction | | |
|---|---|---|---|---|---|---|
| Sheet dimensions, mm | 0.2YS, MPa | UTS, MPa | E, % | 0.2YS, MPa | UTS, MPa | E, % |
| 2.23 × 915 × 1650 | 978 | 1049 | 12.0 | 1071 | 1073 | 8.0 |
| 2.032 × 1219 × 3658 | 876 | 903 | 15.6 | 888 | 916 | 10.6 |

Microstructures of the produced sheets are given in FIG. 1, wherein FIG. 1*a*) shows the microstructure of the sheets produced by the method according to Example 1 of the present invention; and FIG. 1*b*) shows the microstructure of the sheets produced by the method according to Example 2 of the present invention.

An analysis of the microstructures showed that an average size of α-phase grains was less than 1 μm, and this size is substantially lower (3-5 times) than the grain size of commercial product sheets.

Figure 2:
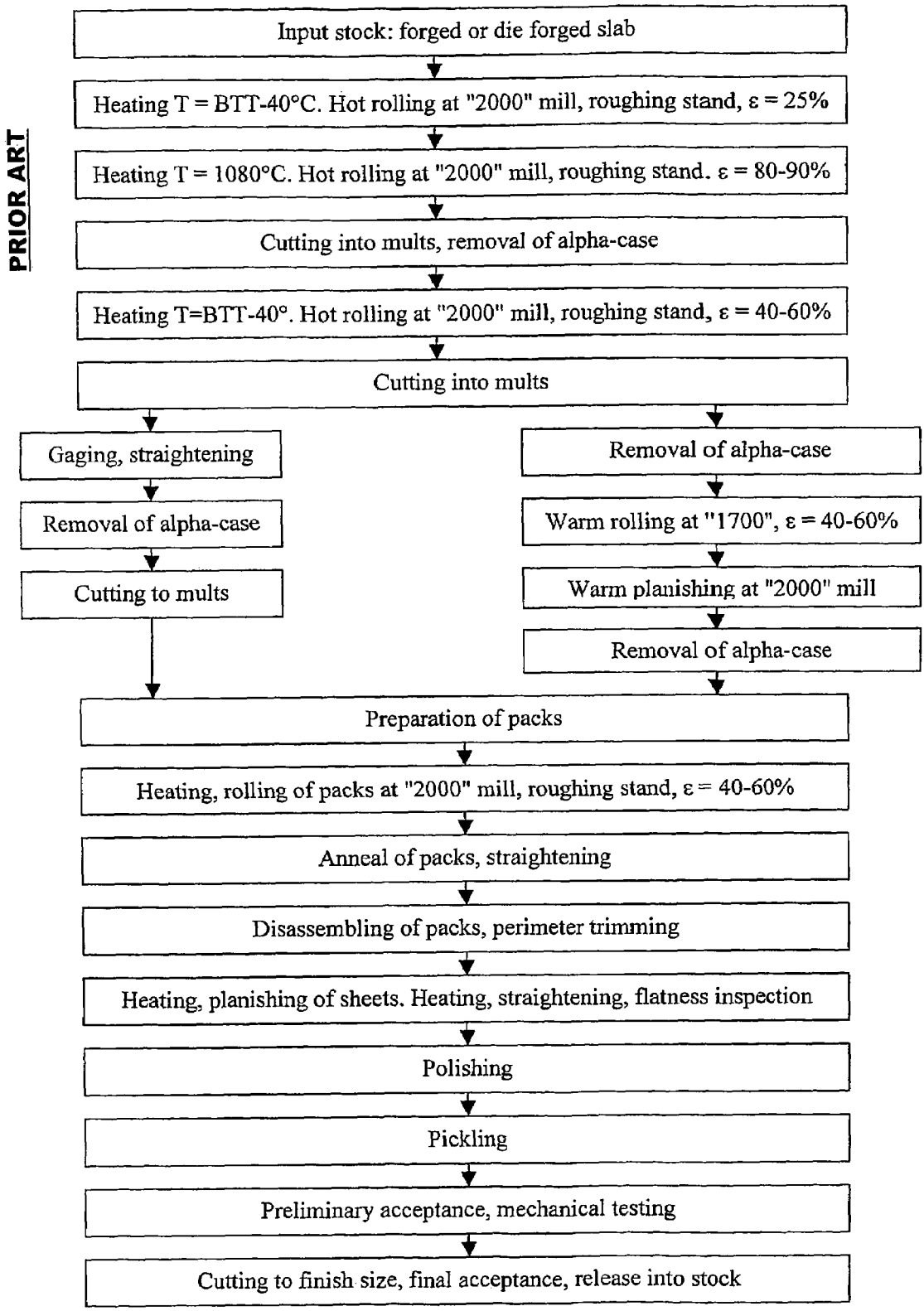
FIG. 2 is a schematic diagram showing the prior art method for manufacture of the commercial product thin sheets.
Figure 3:
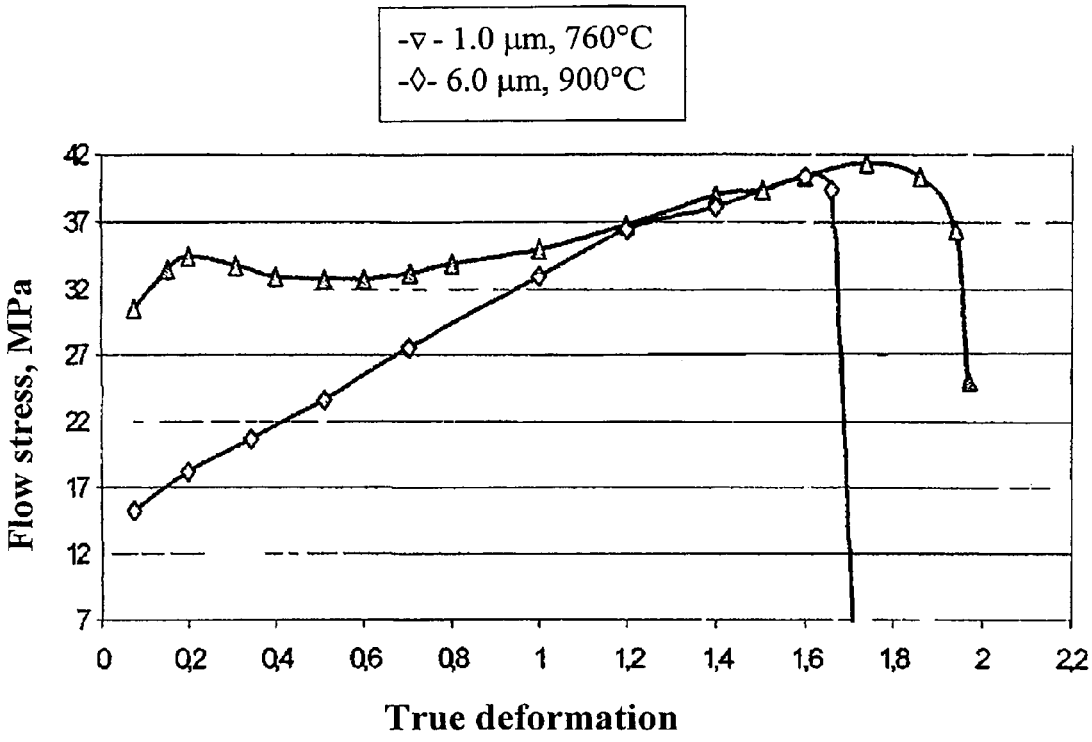
FIG. 3 is a plot showing test results for the sheets produced according to the present invention and for the commercial product sheets of the prior art, said test results being obtained during SPF at a strain rate of $3\cdot10^{-4}$ $sec^{-1}$ at temperatures of 760° C. and 900° C., respectively.

Samples of the sheets produced according to the present invention and samples of the commercial product sheets produced according to the conventional method shown in FIG. 2 were tested for superplastic forming (SPF) at a strain rate of $3\cdot10^{-4}$ $sec^{-1}$ at the temperatures of 760° C. and 900° C., respectively. The results are shown in FIG. 3.

An analysis of the test results reveals that a flow stress for the samples of commercial product sheets which have a grain size of 6.0 μm and which were tested at 900° C. does not practically differ from a flow stress for the sheets of the present invention having the grain size of below 1.0 μm but tested at 760° C. (e.g., at a value of true deformation=1.1, the flow stress does not exceed 35 MPa). At the same time, the true deformation at rupture of the 1.0 μm grain size samples according to the present invention was 2.0 against 1.7 for the samples of commercial product sheets. Thus, the sheets manufactured according to the present invention are suitable for superplastic forming at the temperature of 760° C.

Therefore, the suggested method allows to produce, by means of the currently existed equipment, i.e. without involving additional capital investment costs, big-sized thin sheets made of high-strength titanium alloys, said sheets having the desirable homogeneous submicrocrystalline structure and the required mechanical properties suitable for the SPF at the temperatures lower than 800° C.

Such the decrease of SPF temperature allows to significantly increase resistance of the dies during the SPF forging process and to decrease electricity consumption during operation of the furnaces. Besides, such decrease of the sheet heating temperature before the SPF forging allows to minimize costs involved in irretrievable metal losses associated with surface cleaning of the articles from scale and gas-saturated layer after the SPF forging process. The irretrievable losses of the metal decrease 3-10 times depending on the SPF conditions.

While various preferred embodiments have been described, those skilled in the art will recognize modifications or variations which might be made without departing from the inventive concept. The examples illustrate the invention and are not intended to limit it. Therefore, the description and claims should be interpreted liberally with only such limitation as is necessary in view of the pertinent prior art.

What is claimed is:

1. A method for manufacturing thin sheets of high-strength titanium 5 alloys, said method including:

preparing initial blanks;

assembling the initial blanks into a pack within a sheath, and heating and hot rolling the pack of the initial blanks in the sheath;

in the operation of preparing the initial blanks, the blanks having an α-phase grain size of not more than 2 μm are produced by hot rolling a forged or die-forged slab to a predetermined value of a relative thickness $h_B$/hF, where $h_B$is a thickness in millimeters of the initial blank before said pack hot rolling and hF is a final sheet thickness in millimeters, and by heat treating the initial blanks followed by rapidly cooling; and in that the operation of pack hot rolling is conducted at a temperature of from about 650° C. to about 750° C. first in a direction transverse with respect to a slab rolling direction, and to achieve a thickness reduction of the pack of about 60%-70%, and then changing a rolling direction by about 90° C. and pack hot rolling to achieve an additional degree of thickness reduction of the pack.

2. The method according to claim 1, characterized in that said predetermined value of relative thickness $h_B/h_F$ is from about 8 to about 10.

3. The method according to claim 1, characterized in that said heat treatment of the initial blanks followed by said rapid cooling are performed after achievement of the required thickness $h_B$ of the initial blank by heating the initial blank to a temperature from about 50 to about 150° C. higher than the beta-transus temperature (BTT), by keeping the initial blank at this temperature for about 15 to about 50 minutes, and by rapidly cooling the initial blanks in water at a cooling rate of from about 200 to about 400° C./min.

4. The method according to claim 1, characterized in that a temperature of said pack hot rolling is set in the range of from about 200 to about 300° C. lower than the BTT.

5. The method according to claim 1, characterized in that said change of the pack rolling direction by about 90°. is performed after the predetermined total reduction of from about 60 to about 70% in one direction is achieved.

6. The method according to claim 1, characterized in that a partial reduction value of the pack in one heating cycle during said pack hot rolling is not less than 10%, the reduction in each subsequent pack rolling run being not greater than that in the previous pack rolling run.

7. The method according to claim 1, characterized in that the temperature of each subsequent pack rolling run is not higher than that of the previous pack rolling run.

8. A method for manufacturing thin sheets of high-strength titanium alloys, said method including —the steps of preparing initial card blanks, assembling the initial card blanks into a pack within a steel case, heating and hot rolling the pack of the initial card blanks in the steel case, and annealing, the method being characterized in that, in the step of preparing the initial card blanks, blanks having an a-phase grain size of not more than 2 pm are produced by hot rolling a forged or die-forged slab to a predetermined value of a relative thickness $h_B/h_F$=8 to 10, where $h_B$ is a thickness in mm of the initial card blank before said pack hot rolling and hF is a final sheet thickness in mm; and the thus produced initial card blanks are heated to a temperature from about 50 to about 150° C. higher than the beta-transus temperature (BTT), are kept at this temperature for about 15 to about 50 minutes, and are quenched by cooling in water at a cooling rate of from about 200 to about 400° C./min; and the pack hot rolling in the steel case heated up to a temperature of from about 650 to about 750° C. is firstly conducted in a longitudinal or transverse direction with respect to the rolling direction of the slab at a total reduction of from about 60 to about 70%, and is subsequently conducted at the same temperature-reduction parameters in a direction perpendicular to the direction of the first pack hot rolling; and, after said pack hot rolling, the steel case is annealed at a temperature of from about 650 to about 700° C. for a time period of about 30 to about 60 minutes.

* * * * *